US007266908B2

(12) United States Patent
Issler

(10) Patent No.: US 7,266,908 B2
(45) Date of Patent: Sep. 11, 2007

(54) FOOTBED PLUG

(75) Inventor: David C. Issler, North Andover, MA (US)

(73) Assignee: Columbia Insurance Company, Omaha, NE (US)

( * ) Notice: Subject to any disclaimer, the term of this patent is extended or adjusted under 35 U.S.C. 154(b) by 45 days.

(21) Appl. No.: 10/057,503

(22) Filed: Jan. 25, 2002

(65) Prior Publication Data

US 2003/0140523 A1 Jul. 31, 2003

(51) Int. Cl.
*A43B 13/18* (2006.01)

(52) U.S. Cl. ..... 36/28; 36/30 R

(58) Field of Classification Search ..... 36/30 R, 36/28, 37, 23, 24, 15, 105, 36 B, 36 R, 42
See application file for complete search history.

(56) References Cited

U.S. PATENT DOCUMENTS

| | | | | | |
|---|---|---|---|---|---|
| 844,882 | A * | 2/1907 | Lober | 36/30 R |
| 1,717,122 | A * | 6/1929 | Schaff | 36/36 R |
| 1,724,349 | A * | 8/1929 | Haag | 36/36 R |
| 3,538,628 | A * | 11/1970 | Einstein, Jr. | 36/15 |
| 4,366,630 | A * | 1/1983 | Bloom | 36/30 R |
| 4,510,700 | A * | 4/1985 | Brown | 36/28 |
| 5,079,856 | A * | 1/1992 | Truelsen | 36/25 R |
| 5,133,138 | A * | 7/1992 | Durcho | 36/36 R |
| 5,311,677 | A * | 5/1994 | Mann et al. | 36/35 R |
| 5,469,639 | A * | 11/1995 | Sessa | 36/28 |
| 5,775,005 | A * | 7/1998 | McClelland | 36/31 |
| 6,145,220 | A * | 11/2000 | Johnson, Jr. et al. | 36/30 R |
| 6,330,757 | B1 * | 12/2001 | Russell | 36/28 |
| 6,519,874 | B1 * | 2/2003 | Dean | 36/30 R |
| 6,691,432 | B2 * | 2/2004 | Masseroñ | 36/28 |

FOREIGN PATENT DOCUMENTS

FR 2819385 A1 * 7/2002

* cited by examiner

*Primary Examiner*—Ted Kavanaugh
(74) *Attorney, Agent, or Firm*—St. Onge Steward Johnston & Reens LLC

(57) ABSTRACT

An outsole assembly is provided that includes an outsole having an inner surface including an opening, and a footbed positioned over the inner surface of the outsole, the footbed having an outer surface including a plug configured to be inserted into the opening. The outsole assembly enhances comfort by providing greater support and cushion in the heel area.

28 Claims, 6 Drawing Sheets

FOOTBED PLUG

TECHNICAL FIELD

This invention relates to footwear and outsole assemblies used in the construction of footwear.

BACKGROUND

For either low or high impact walking activities, the heel area is the first area of the foot to come in contact with hard and abrasive surfaces such as cement. Generally, in an effort to correctly distribute pressure on the heel and to provide comfort, absorb shock, and relieve foot pain, a number of different heel support systems can be used.

SUMMARY

In a general aspect of the invention, an outsole assembly includes an outsole having an inner surface including an opening and a footbed placed over the inner surface of the outsole. The footbed provides an outer surface with a plug configured to be inserted into the opening.

In embodiments of the invention, one or more of the following features may also be included. The footbed is formed of a material having a first hardness characteristic that is less than a second hardness characteristic of an outsole material. For example, the plug is formed of a material having a first hardness characteristic that is less than a second hardness characteristic of an outsole material. In certain embodiments, the footbed and the plug are formed of a material having substantially the same hardness characteristics. For example, the outsole is formed of a material having an A-scale durometer hardness between 60A and 100A, and the footbed and the plug are formed of a material having an A-scale durometer hardness between 30A and 60A.

The plug includes a pedestal section and a cap section with the pedestal section being connected to an outer surface of the footbed. Additionally, the cap section includes an outer peripheral edge having an outer peripheral dimension and an inner peripheral edge having an inner peripheral dimension where the inner peripheral edge is connected to the pedestal section having a pedestal peripheral dimension.

As yet another feature, the outer peripheral dimension is substantially the same as the inner peripheral dimension. Also, the inner peripheral dimension is larger than the pedestal peripheral dimension.

Furthermore, the inner peripheral edge forms a projecting lip when the inner peripheral edge is connected to the pedestal section. The opening of the outsole has an opening peripheral dimension that is less than inner peripheral dimension as well as a corresponding matching dimension for mating with the pedestal peripheral dimension.

In certain embodiments, the pedestal peripheral dimension mates with the opening peripheral dimension, forming a relatively watertight fit between the outsole and the footbed.

As yet another feature, the outsole has a walking surface including an indented surface corresponding to the inserted plug. The indented surface forms a non-contact surface with a walking ground.

In another aspect, a method includes providing an outsole having an inner surface including an opening and positioning a footbed over the inner surface of the outsole where the footbed has an outer surface that includes a plug configured to be inserted into the opening.

As another feature, the method also includes forming the footbed using a material having a first hardness characteristic that is less than an outsole material having a second hardness characteristic. Additionally, the method includes forming the plug using a material having a first hardness characteristic that is less than an outsole material having a second hardness characteristic.

In general, the outsole system provides comfort, support, and shock absorption in the heel and arch areas. The outsole system distributes pressure and helps position the foot correctly to relieve pain, especially in the heel area. In particular, it reduces pain and stress caused by a variety of foot ailments such as heel spurs, prolonged walking, Achilles tendonitis, and the like.

Among other advantages, the outsole system provides stabilization and cushioning to position the foot correctly within any type of footwear. It anatomically corrects the arch of the foot and helps position the foot so the heel sits correctly to cushion the heel bone, relieving acute and chronic symptoms related to heel pain. In other words, the outsole system cups the heel and helps control rocking motion of the foot. The outsole system can advantageously prevent further injuries and deterioration of the heel area from high impact or prolonged activities.

The outsole system can be easily incorporated with uppers and/or vamps having a wide variety of casual, dress, or athletic shoe styles to provide the necessary support in the heel area most susceptible to pain and stress.

Another benefit of the outsole system is the durability of the system for outdoors and street-wear usage. The outsole system can be used for many years on abrasive surfaces such as cement, asphalt, or any type of industrial surface.

The outsole system features a durable and comfortable design. The sole provides excellent support characteristics, providing resistance and long-term health benefits to the wearer. In addition, the outsole is lightweight, supple, and easy to care for. Further, the outsole system features secure attachment of the outsole components allowing the outsole to withstand constant abrasive abuse without fear of tears, rips, leaks, and the like.

The details of one or more embodiments of the invention are set forth in the accompanying drawings and the description below. Other features, objects, and advantages of the invention will be apparent from the description and drawings, and from the claims.

DETAILED DESCRIPTION

Referring now to the figures in which identical elements are numbered identically throughout, a description of the embodiments of the present invention will now be provided.

Figure 1:
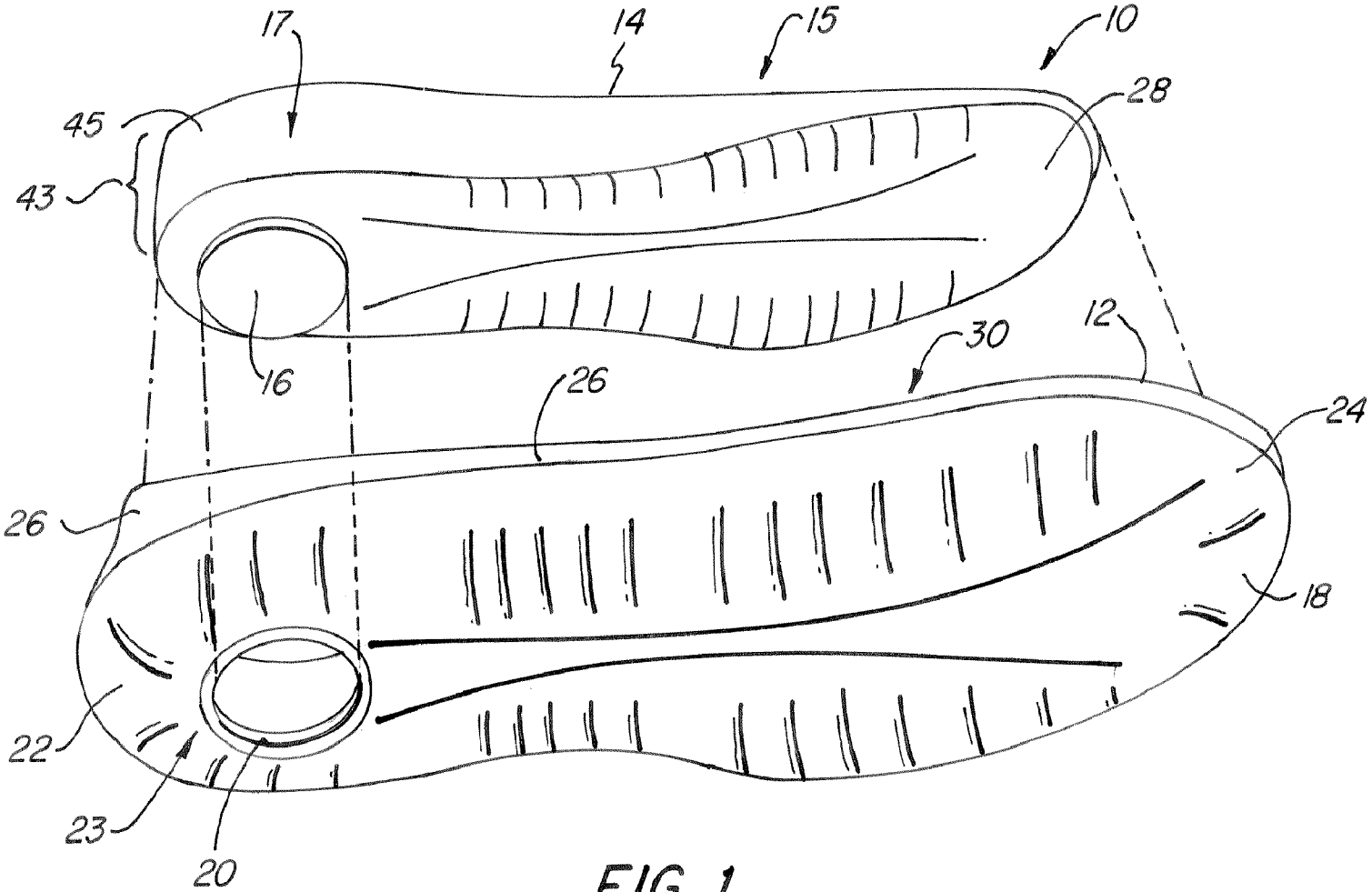
FIG. 1 is an exploded perspective view of an outsole assembly.
Figure 2:
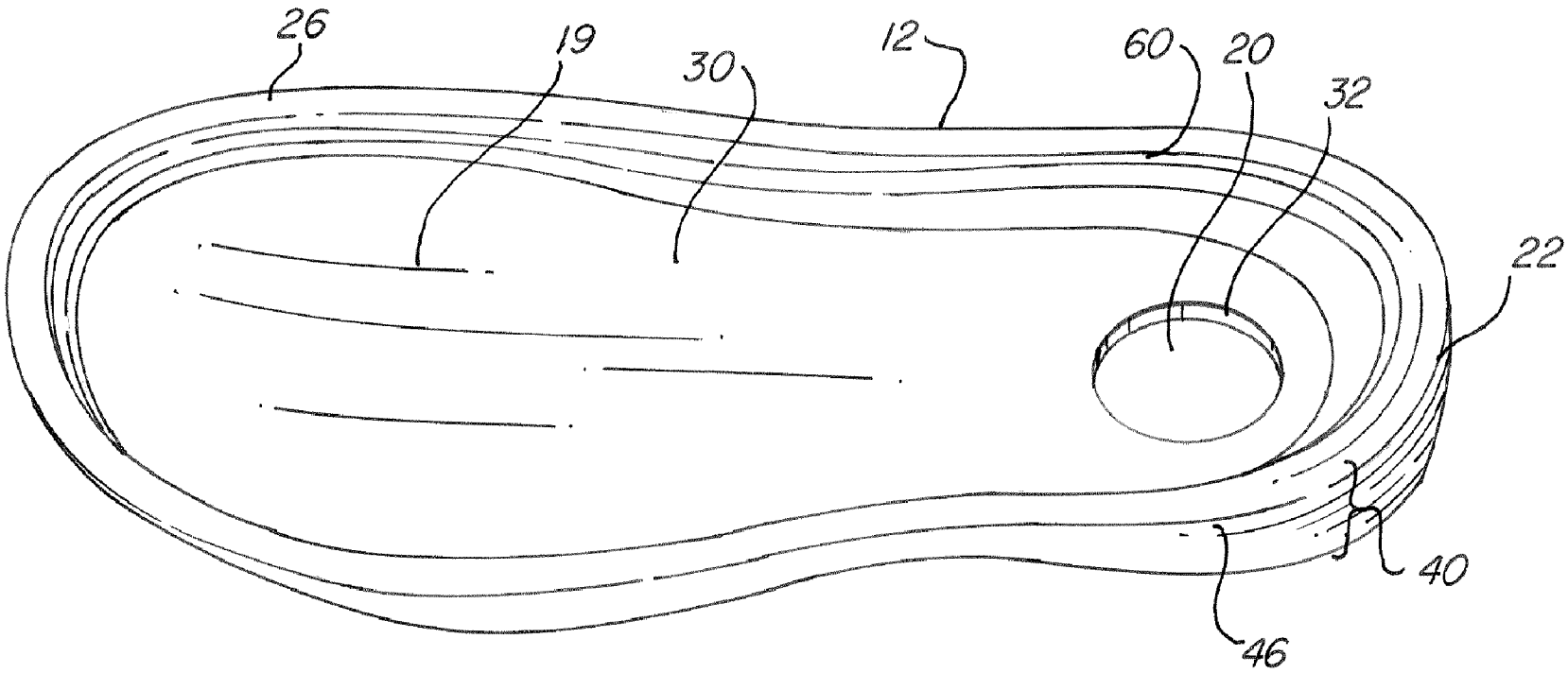
FIG. 2 is a perspective top view of an outsole of the outsole assembly of FIG. 1.

Referring to FIGS. 1 and 2, an outsole assembly 10 includes an outsole 12 and a footbed 14 which has a plug 16 located in a central position of a heel region 17. The outsole assembly 10 is constructed by joining the outsole 12 to the footbed 14 as will be described more fully below.

The outsole 12 has a walking surface 18, a heel region 22, and an opposite toe region 24. The outsole 12 includes, along its periphery, an upstanding wall 26 that surrounds a cavity 30 in an inner surface 19 for receiving the footbed 14. The outsole 12 also includes an opening 20 positioned in the heel region 22. The opening 20 extends from the cavity 30 to the walking surface 18 of the outsole 12 and has an opening perimeter.

The footbed 14 has an under surface 28 that is positioned within the cavity 30, with the plug 16 placed over and inserted into the opening 20 to ensure a tight fit between the plug 16 and the opening 20. Specifically, the opening 20 has a perimeter commensurate with the opening perimeter for tightly mating with the plug 16.

The outsole 12 and the footbed 14 are made of materials, e.g., rubber such as molded polyurethane, each having different hardness characteristics. The hardness characteristic of the footbed 14 and the plug 16 are in the measured range between 30A and 60A (Durometer "A" scale or "Type A") whereas the outsole 12 has a hardness characteristic that is greater then the hardness of the footbed 14 and the plug 16, e.g., in a measured range between 60A to 100A. The footbed 14 and the plug 16 are formed of the same material such as polyurethane having substantially similar hardness characteristics. The plug 16 is integrally molded into the footbed 14 and forms a monolithic unit with the footbed 14.

The footbed 14 may include an inner liner (not shown) covering a footbed upper surface 15 for absorbing moisture and providing more cushioning when the outsole assembly 10 is worn. The inner lining of the footbed 14 may be made of a thinner, absorbent and breathable type of leather or any type of suitable material.

Referring in particular to FIG. 2, the outsole 12 also includes a vertical heel wall 46 in the heel region 22. The vertical heel wall 46 has a height that is commensurate with a height of the footbed 14 for accommodating the footbed within the cavity 30. Once the footbed 14 is placed within the cavity 30, a vamp (not shown) is provided to cover the upper part of the wearer's foot and toes to form a spacing where a wearer's foot can be inserted. A vamp may be either of an open or closed toe design in the toe region 24.

Figure 3:
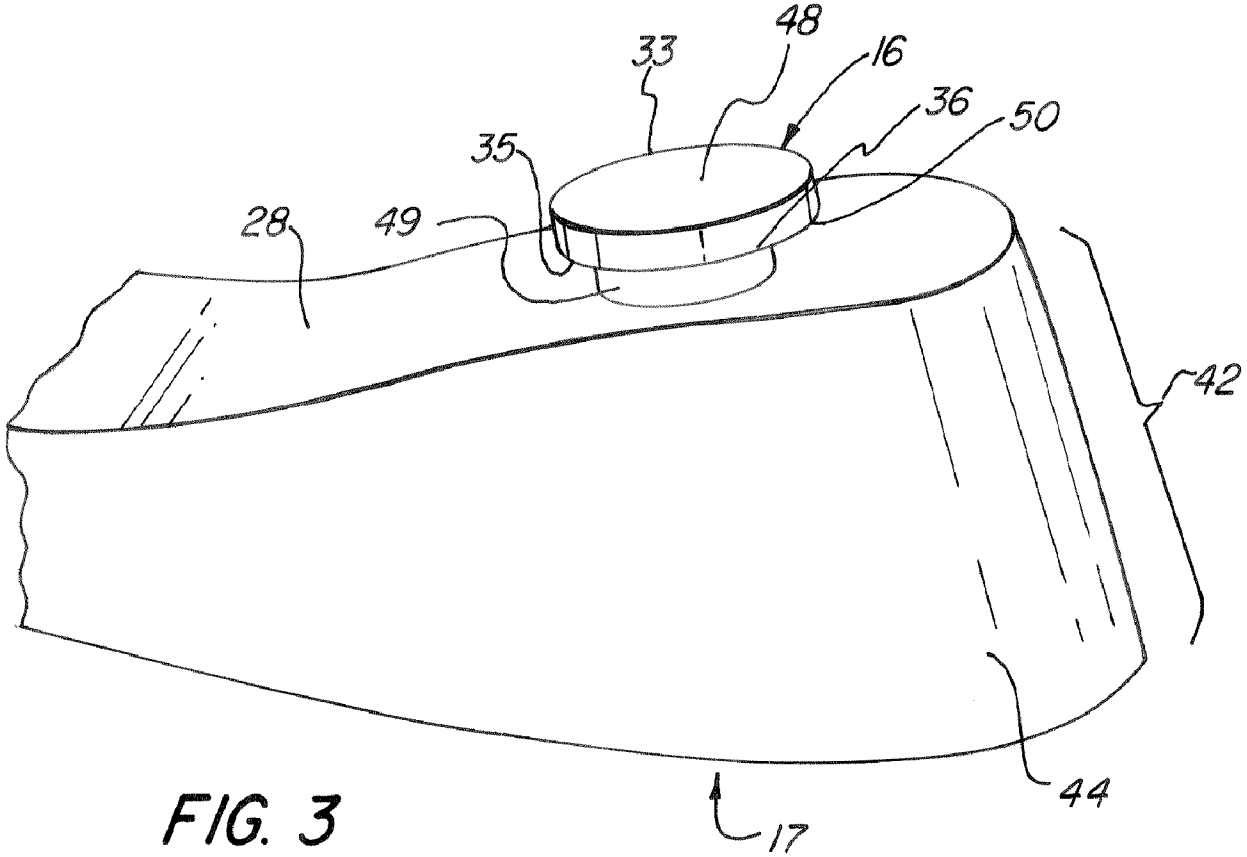
FIG. 3 is a perspective view of a portion of a footbed of the outsole assembly of FIG. 1.

Referring to FIG. 3, the plug 16 includes a cap structure 48 integrally attached to a pedestal structure 49, together having a shape similar to the cork of a champagne bottle. The cap structure 48 includes an outer edge 33 and an inner edge 35 having an equal perimeter length, whereas the pedestal structure 49 has a smaller perimeter than the perimeters of the inner and outer edges. The pedestal structure 49 is connected to the cap structure 48, forming a projecting lip 50 around the entire periphery of the cap structure 48. The projecting lip 50 provides the resistance needed to maintain the cap structure 48 pressed against the walking surface 18 while the pedestal structure 49 securely bridges the cap structure 48 to the footbed 14 (FIG. 1).

Although the cap structure 48 is sufficiently malleable to pass through the perimeter of the opening 20, the perimeter length of the outer edge 33 and the inner edge 35 are larger than the perimeter of the opening 20. Accordingly, after the cap structure 48 has been inserted through the opening 20, the perimeter of the pedestal structure 49 fits tightly and seals the contact between the opening 20 and the cap structure 48 so that the walking surface 18 is completely watertight in the heel region 22, making the walking surface and the now closed opening 20 non-porous to water, dirty, and the like. In other words, the perimeter of the opening is complimentary in length to the perimeter of the pedestal structure 49. Moreover, a width of the outsole 14 in the opening 20 is commensurate with a width of the pedestal structure 49 to provide for the watertight seal in the walking surface 18 of this example. Therefore, the cap structure 48 is like the head of the champagne bottle which is inserted through a hole with the protruding edges of the head providing the structure to hold the head in position just as the projecting lip 50 holds the plug 16 securely in place.

Figure 4:
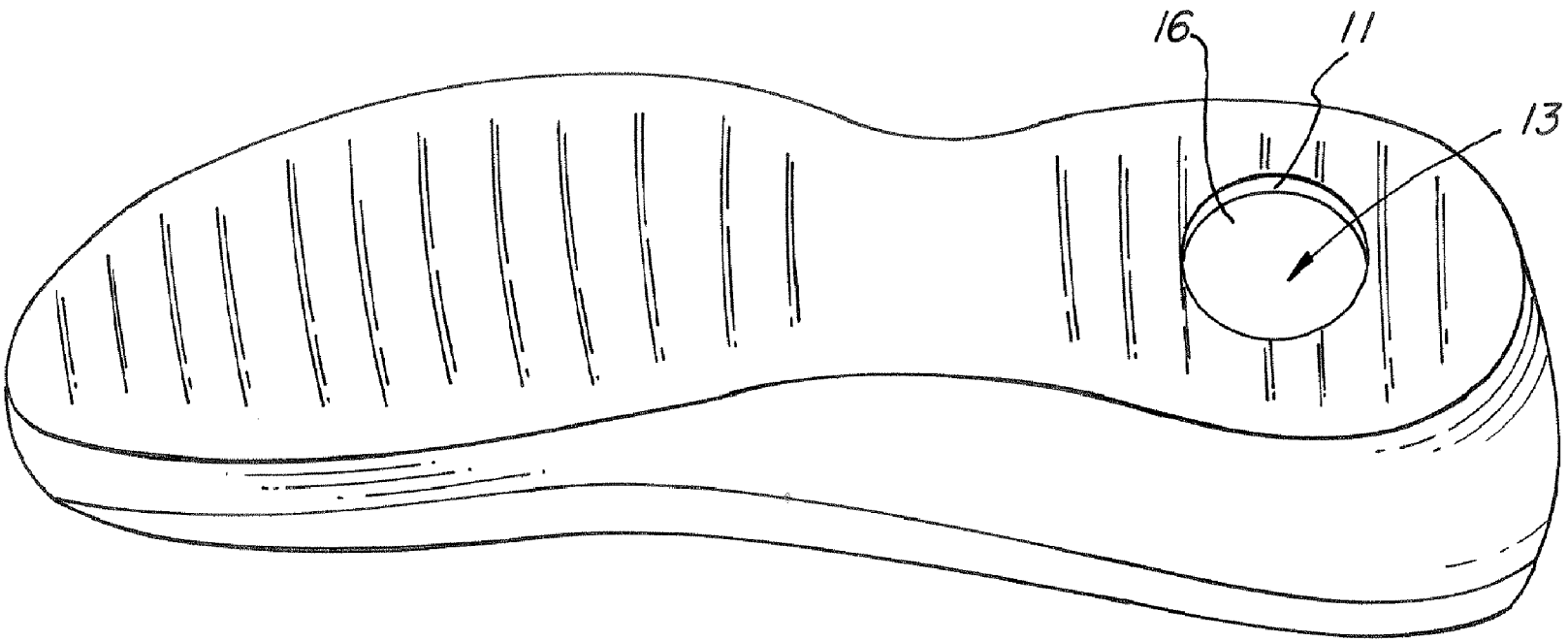
FIG. 4 is a perspective bottom view of the outsole of the outsole assembly of FIG. 1.

Referring to FIG. 4, once inserted, the plug 16 is positioned in an indented surface 13 that is not in contact with any walking ground or cement. The indented surface 13 is positioned below the walking surface 18 of the outsole 12 by about 1.5 mm as illustrated by an impressed region 11. This prevents any wear and tear of the cap section 48.

Figure 5:
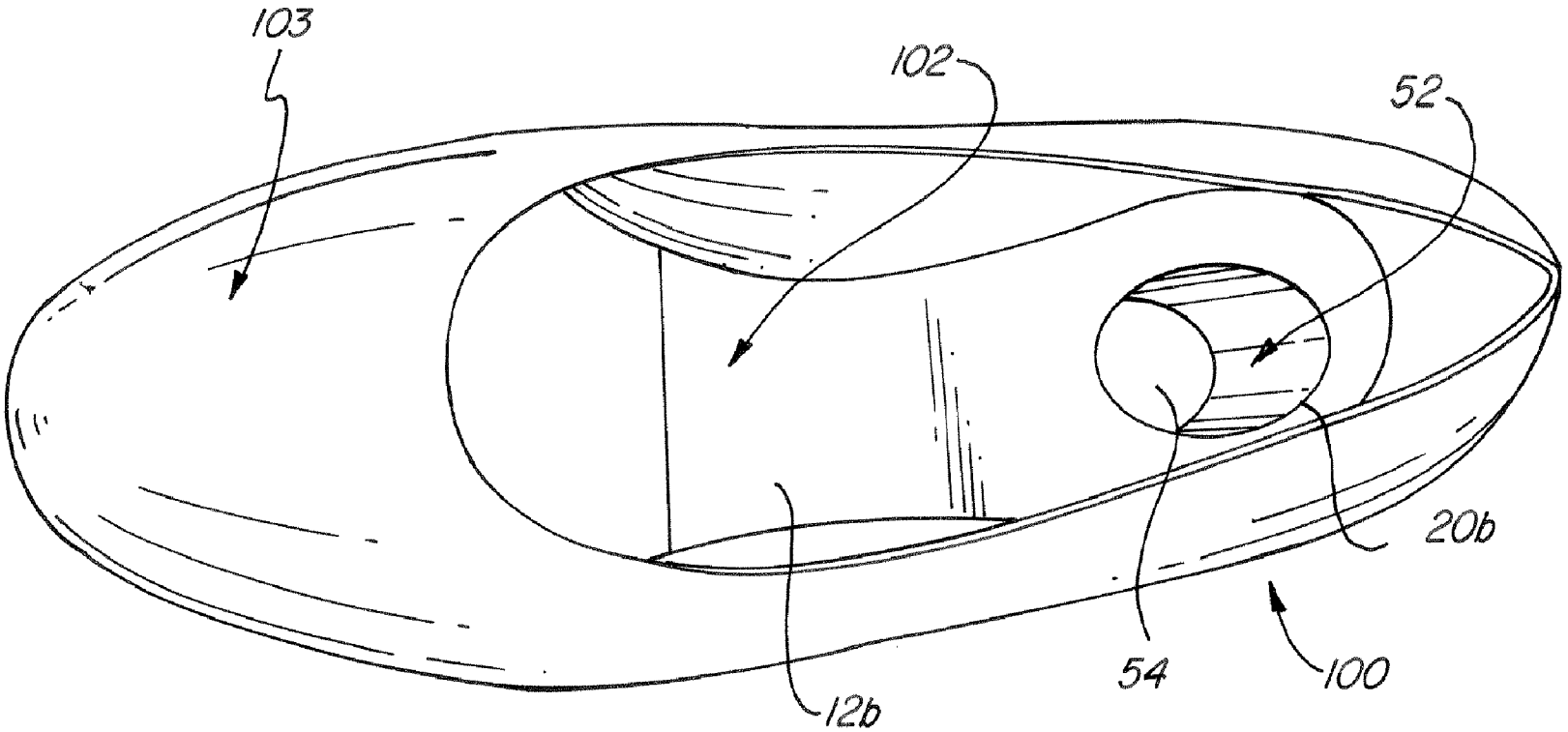
FIG. 5 is an exploded perspective view of another outsole assembly.
Figure 6:
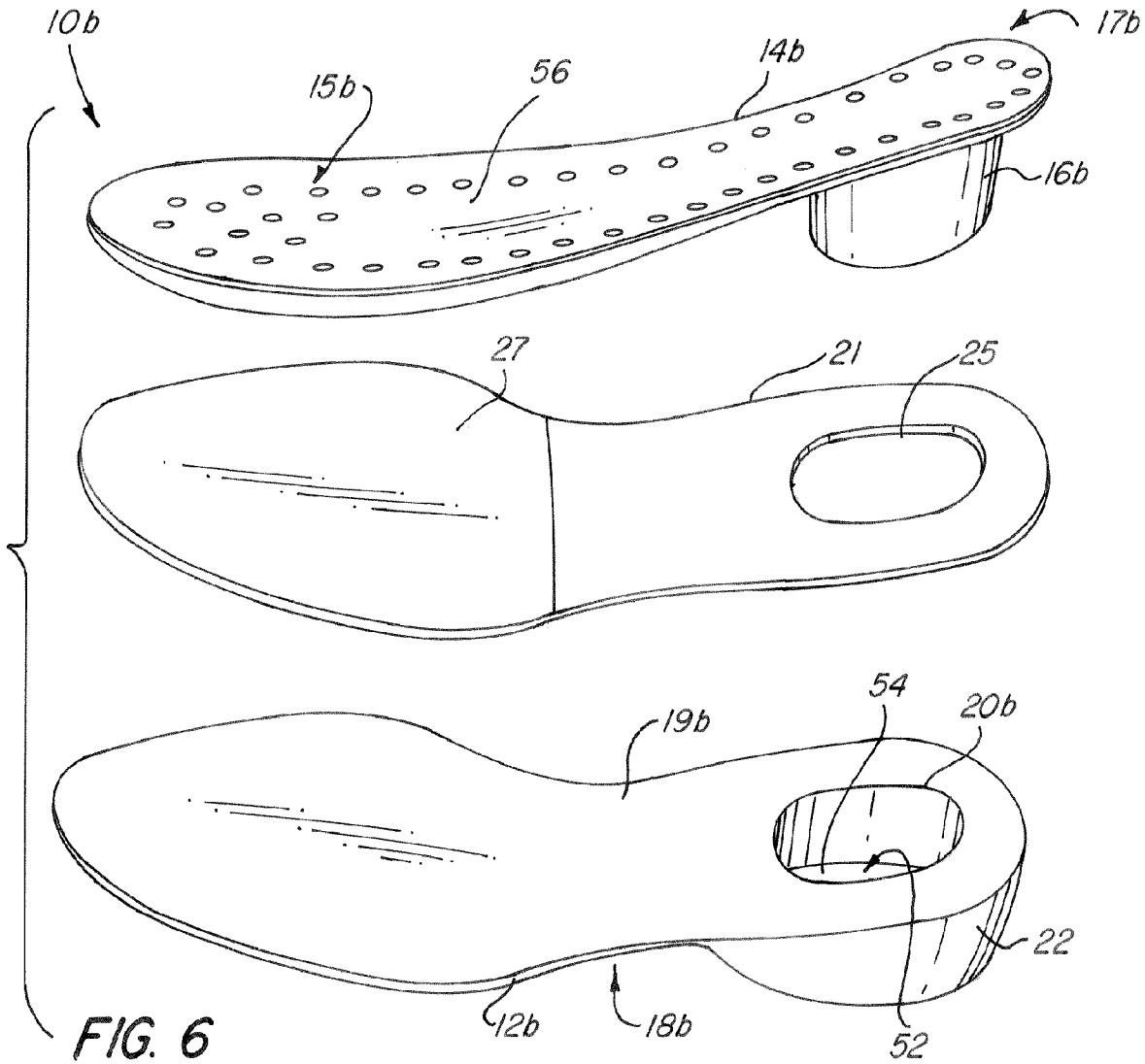
FIG. 6 is an exploded perspective view of an outsole and a footbed of the outsole assembly of FIG. 5.

Referring to FIGS. 5 and 6, a shoe 100 having an outsole assembly 10*b* with an outsole 12*b* for receiving a footbed 14*b* that includes a plug 16*b* is illustrated. FIG. 6 illustrates an area defining a volume 102 for placement of a wearer's foot. The outsole assembly 10*b* includes the outsole 12*b* that has an opening 20*b* integral to a cavity 52 including a cavity base 54. The outsole assembly 10*b* also includes an insole 21 with an aperture 25 corresponding in peripheral dimension to the cavity 52 of the outsole 12*b*. The insole 21 is fibrous and securely attached to an inner surface 19*b* of the outsole 12*b* by an adhesive material. The insole 21 also includes a fiber tuck 27. The cavity base 54 prevents the opening 20*b* from extending from the inner surface 19*b* all the way to a walking surface 18*b*. The footbed 14*b* includes a plug 16*b* in a heel region 17*b*, where the plug 16*b* is configured to be positioned within the cavity 52 and be attached against the cavity base 54 for a secure attachment of the footbed 14*b* to the outsole 12*b*. In a footbed upper surface 15*b*, the footbed 14*b* includes a porous sockliner 56 for providing further cushioning.

The construction method of the various examples of outsole assemblies described above will now be described in conjunction with the accompanying figures.

In preparation for constructing the outsole assembly 10 illustrated in FIG. 1, the vamp (not shown) is cemented to an upstanding wall 60 of the outsole 12 and then hand-sewn to the outsole assembly 10. The footbed 14 is prepared by providing in the footbed upper surface 15 a hydrophilic foam (not shown) and a leather cover (not shown). The footbed 14 is then inserted within the attachment cavity 30. A last (not shown) is forced into the cavity 30 and pressed, thus forcing the plug 16 of the footbed 14 into the opening 20 in the heel region 22 of the outsole 12. The footbed upper surface 15 of the footbed 14 is anatomically shaped and requires that the last provide a bottom showing the negative of the footbed 14. The bottom of the last (not shown) has a partially concave bottom to allow for a convex protuberance of the footbed 14 at the walking surface 18*b*.

Referring back to FIG. 6, for this embodiment, the vamp or upper 103 is cement lasted over the insole 21 and finished with the corresponding outsole 12*b*, ready to accept the footbed 14*b* with the plug 16*b* in the heel region 17*b*. The foot-wear 100 is conventionally finished, except that the outsole 12*b* includes the cavity 52 that receives the plug 16*b* of the footbed 14*b*. The footbed 14*b* may be prepared with a hydrophilic foam or other foam cover and leather.

Although the outsole assembly 10 is shown having a heel height 45 having a height 43, the outsole assembly 10 may be made to accommodate and fit heels of various sizes, such as heel 44 having predetermined height of 42. Moreover, the method of construction herein described relates to general methods of footwear and outsole manufacturing that are entirely within the scope of the invention. Furthermore, a number of embodiments of the invention have been described. Nevertheless, it will be understood that various modifications may be made without departing from the spirit and scope of the invention. Accordingly, other embodiments are within the scope of the following claims.

What is claimed is:

1. An outsole assembly comprising:

a heel region having a generally flat innermost surface, a generally flat outermost surface generally parallel with said innermost surface and adapted to be in contact with a walking surface, and an opening extending from said innermost surface to said outermost surface;

a footbed positioned over an area of said innermost surface of said heel region;

a plug combined with said footbed to provide a single unit and placed in said opening for enhancing comfort; and a clearance in a location at least partially defined by a bottom perimeter of said plug and a distance between said bottom perimeter and said outermost surface;

wherein said clearance permits said plug to expand and absorb shock.

2. The assembly of claim 1 wherein the footbed is formed of a material having a first hardness characteristic that is less than an outsole material having a second hardness characteristic.

3. The assembly of claim 1 wherein the plug is formed of a material having a first hardness characteristic that is less than an outsole material having a second hardness characteristic.

4. The assembly of claim 1 wherein the footbed and the plug are formed of a material having substantially the same hardness characteristic.

5. The assembly of claim 1 wherein the outsole is formed of a material having an A-scale durometer hardness in a range between 60A and 100A.

6. The assembly of claim 5 wherein the footbed and the plug are formed of a material having an A-scale durometer hardness in a range between 30A and 60A.

7. The assembly of claim 1 wherein the opening is positioned in a heel region of the inner surface of the heel region.

8. The assembly of claim 1 wherein the plug includes a pedestal section and a cap section, the pedestal section being connected to the outer surface of the footbed.

9. The assembly of claim 8 wherein the cap section includes an outer peripheral edge having an outer perimeter and an inner peripheral edge having an inner perimeter, the inner peripheral edge being connected to the pedestal section having a pedestal perimeter.

10. The assembly of claim 9 wherein the outer perimeter is substantially the same as the inner perimeter.

11. The assembly of claim 10 wherein the inner perimeter is larger than the pedestal perimeter.

12. The assembly of claim 11 wherein the inner peripheral edge forms a projecting lip when connected to the pedestal section.

13. The assembly of claim 12 wherein the opening of the heel region has:

an opening perimeter that is less than the inner perimeter; and a corresponding matching perimeter for mating with the pedestal perimeter.

14. The assembly of claim 13 wherein the pedestal peripheral dimension mated with the opening peripheral dimension forms a watertight seal between the heel region and the footbed.

15. The assembly of claim 1 wherein the heel region includes an indented surface corresponding to the inserted plug.

16. The assembly of claim 15 wherein the indented surface is a non-contact surface with the walking surface.

17. A method comprising:

providing a heel region having a generally flat innermost surface and a generally flat outermost surface generally parallel with the innermost surface and adapted to be in contact with a walking surface;

extending an opening from the innermost surface to the outermost surface;

positioning a footbed over an area of the inner surface of the heel region;

connecting the footbed and plug together to provide a single unit;

placing a plug in the opening for enhancing comfort;

providing a clearance from the opening in a location at least partially defined by a bottom perimeter of the plug and a distance between the bottom perimeter and the outermost surface; and permitting the plug to expand and absorb shock within the clearance.

18. The method of claim 17 further comprising forming the footbed using a material having a first hardness characteristic that is less than an outsole material having a second hardness characteristic.

19. The method of claim 17 further comprising forming the plug using a material having a first hardness characteristic that is less than an outsole material having a second hardness characteristic.

20. The method of claim 17 further comprising using a material having an A-scale durometer hardness in a range between 60A and 100A for the outsole.

21. The method of claim 17 further comprising using a material having an A-scale durometer hardness in a range between 30A and 60A for the footbed and the plug.

22. The method of claim 17 further comprising providing a pedestal section and a cap section in the plug wherein the pedestal section is connected to the outer surface of the footbed.

23. The method of claim 22 further comprising forming a projected lip by connecting the cap section to the pedestal section.

24. An outsole assembly, comprising:

an outsole having a generally flat innermost surface and a generally flat outermost surface generally parallel with said innermost surface and adapted to be in contact with a walking surface;

an opening extending downwardly from said innermost surface toward said outermost surface;

a footbed extending over an entire said innermost surface;

a plug combined with said footbed to provide a single unit and placed in said opening for enhancing comfort; and a clearance in a location at least partially defined by a bottom perimeter of said plug and a distance between said bottom perimeter and said outermost surface:

wherein said clearance permits said plug to expand and absorb shock.

25. The footwear assembly of claim 24 wherein the footbed is formed of a material having a first hardness characteristic that is less than an outsole material having a second hardness characteristic.

26. The outsole according to claim 24, wherein said plug includes a first protrusion having a first periphery in contact with a lower surface of said footbed and wherein said plug further includes a second protrusion having a second periphery, where said second periphery is larger than said first periphery, in contact with said first protrusion and wherein said first and second protrusions extend downwardly into said opening.

27. An outsole assembly comprising:

an outsole having a generally flat innermost surface, a generally flat outermost surface generally parallel with said innermost surface and adapted to be in contact with a walking surface, and an opening extending from said innermost surface to said outermost surface;

a footbed positioned over an area of said innermost surface;

a plug extending downwardly from said footbed and into said opening;

said plug having a bottom surface and a perimeter around said bottom surface;

a clearance in a location at least partially defined by said perimeter and a distance between said bottom surface and said outermost surface for providing room for said plug to expand and for inhibiting wear to said plug.

28. The assembly of claim 27, wherein said plug is integrally connected to said footbed.

* * * * *